US008117948B2

(12) United States Patent
Buchanan

(10) Patent No.: US 8,117,948 B2
(45) Date of Patent: Feb. 21, 2012

(54) WRENCH

(75) Inventor: Nigel A. Buchanan, Fife (GB)

(73) Assignee: American Grease Stick Company, Muskegon Heights, MI (US)

( * ) Notice: Subject to any disclaimer, the term of this patent is extended or adjusted under 35 U.S.C. 154(b) by 338 days.

(21) Appl. No.: 12/259,591

(22) Filed: Oct. 28, 2008

(65) Prior Publication Data

US 2009/0107302 A1 Apr. 30, 2009

(30) Foreign Application Priority Data

Oct. 29, 2007 (GB) ..... 0721222.8
Dec. 17, 2007 (GB) ..... 0724571.5

(51) Int. Cl.
*B25B 13/06* (2006.01)

(52) U.S. Cl. ..... 81/64; 81/111

(58) Field of Classification Search ..... 81/64, 124.5, 81/177.6, 124.2, 91.2, 90.7, 90.6, 98, 111
See application file for complete search history.

(56) References Cited

U.S. PATENT DOCUMENTS

| | | | | |
|---|---|---|---|---|
| 131,252 | A | 9/1872 | Craig | |
| 553,015 | A | 1/1896 | Pember | |
| 1,101,022 | A | 6/1914 | Goodwin | |
| 1,186,807 | A | 6/1916 | Litomy | |
| 1,402,373 | A | 1/1922 | Palmer | |
| 1,573,409 | A | 2/1926 | Lynch et al. | |
| 2,655,064 | A | 10/1953 | Simon et al. | |
| 2,766,648 | A | 10/1956 | Jaswieck | |
| 2,824,476 | A | 2/1958 | Wilson | |
| 3,668,950 | A | 6/1972 | Tyler | |
| 3,780,604 | A * | 12/1973 | Wood et al. | 81/64 |
| 4,130,032 | A | 12/1978 | Giandomenico | |
| 4,269,311 | A | 5/1981 | Rich | |
| 4,593,585 | A | 6/1986 | Hurtig | |
| 4,967,612 | A | 11/1990 | Sparling | |
| 5,201,257 | A | 4/1993 | Engel | |
| 5,557,992 | A | 9/1996 | Macor | |

(Continued)

FOREIGN PATENT DOCUMENTS

DE 599682 10/1932

(Continued)

OTHER PUBLICATIONS

European Search Report for corresponding European Application Serial No. 08167823.7.

*Primary Examiner* — Debra S Meislin
(74) *Attorney, Agent, or Firm* — Gardner, Linn, Burkhart & Flory, LLP

(57) ABSTRACT

A wrench comprises a handle portion, a head portion releasably secured to the handle portion and a release device. The head portion has an inner surface that defines a fastener receiving aperture and a side entry to the fastener receiving aperture and is movable relative to the handle portion between a loading position in which the side entry is open and an operating position in which the side entry is closed. The head portion is operable to close around a fastener received in the fastener receiving aperture in response to a torque applied in a predetermined direction using the handle portion. The release device is arranged to at least assist in releasing the head portion from the handle portion to permit the head portion to be separated from the handle portion.

44 Claims, 2 Drawing Sheets

U.S. PATENT DOCUMENTS

| | | | | |
|---|---|---|---|---|
| RE35,424 | E | 1/1997 | Seals | |
| 5,983,759 | A | 11/1999 | Turner | |
| 6,079,301 | A | 6/2000 | Scolo | |
| 6,182,541 | B1 | 2/2001 | Anderson et al. | |
| 6,305,254 | B1 | 10/2001 | Hsieh | |
| 6,339,978 | B1 * | 1/2002 | Hirse | 81/99 |
| 6,763,543 | B2 | 7/2004 | Rivera | |
| 6,978,701 | B1 | 12/2005 | Buchanan | |
| 6,988,430 | B1 | 1/2006 | Putney et al. | |
| 7,073,413 | B2 | 7/2006 | Duffy et al. | |
| 7,424,839 | B2 * | 9/2008 | Chiang | 81/177.8 |
| 2004/0035260 | A1 * | 2/2004 | Adkison | 81/124.2 |
| 2005/0028649 | A1 | 2/2005 | Settanni | |
| 2006/0174730 | A1 | 8/2006 | Stewart | |
| 2008/0216611 | A1 * | 9/2008 | Resnick | 81/124.2 |

FOREIGN PATENT DOCUMENTS

| | | |
|---|---|---|
| DE | 1603875 | 6/1967 |
| DE | 2522696 | 12/1976 |
| DE | 29821725 | 5/1999 |
| FR | 592653 | 8/1925 |
| GB | 235434 | 6/1925 |
| GB | 2007567 | 5/1979 |
| WO | 0058057 | 10/2000 |
| WO | 03035327 | 5/2003 |

* cited by examiner

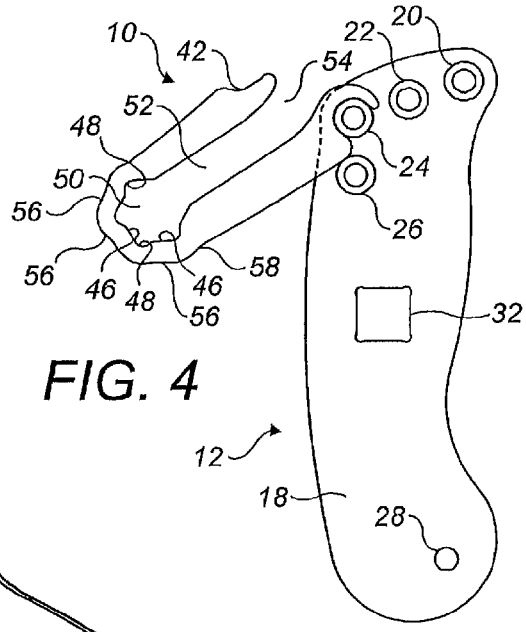
FIG. 4
FIG. 5
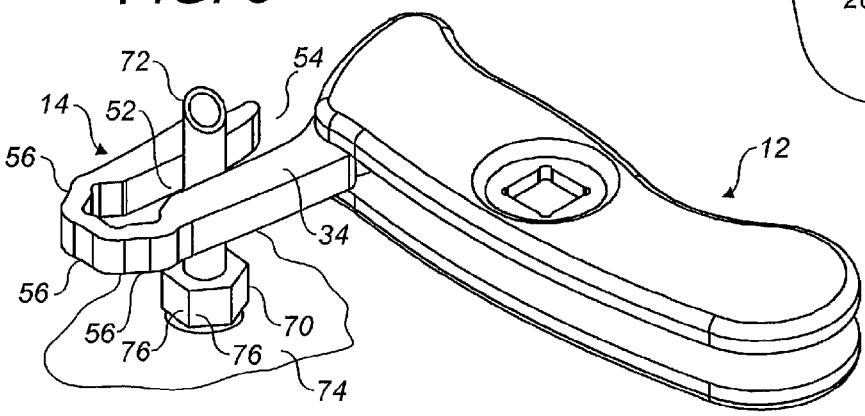
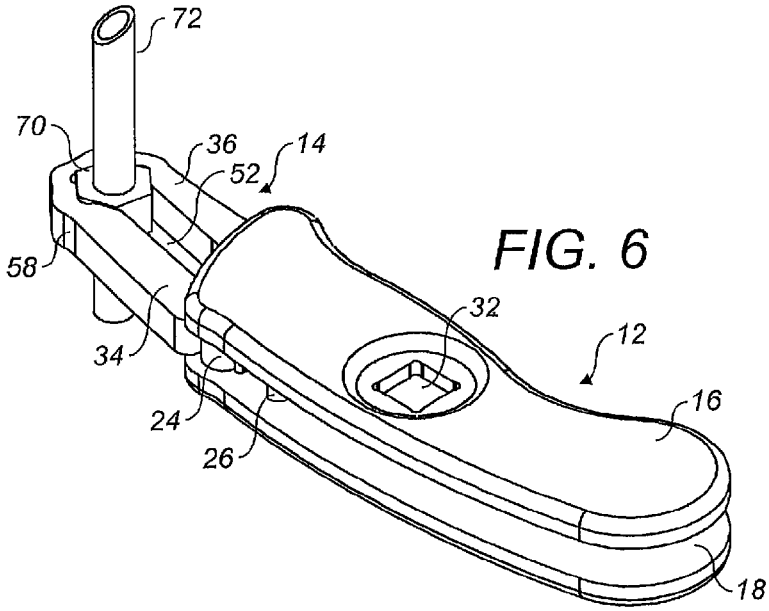
FIG. 6

WRENCH

FIELD OF THE INVENTION

The invention relates to wrenches (known in the United Kingdom as spanners).

BACKGROUND TO THE INVENTION

A wrench is a tool for applying torque to fasteners, such as nuts and bolts, for the purpose of tightening or slackening the fastener. In general, wrenches are designed to be used on fasteners that have a polygonal drive receiving portion comprising a number of generally flat drive receiving surfaces. The head portion of an open ended wrench comprises an open-sided fastener receiving aperture having a pair of opposed fastener engaging surfaces that are spaced apart by a distance corresponding to the size of fastener they are designed to be used on. Ring wrenches have a generally circular head portion that defines a closed fastener receiving aperture. The internal surface defining the aperture is shaped to engage the type and size of fastener it is designed to be used on.

Particularly in cases in which high levels of torque need to be applied to a fastener, a ring wrench is the better tool. An open ended wrench only has two torque applying surfaces and, particularly when high levels of torque are being applied, they can easily slip off of the fastener. This usually results in damage to the fastener. Specifically, the corners formed where adjacent drive receiving surfaces meet are rounded off making it more difficult for the wrench to successfully apply high levels of torque to the fastener. Ultimately, the damage can effectively round off the fastener drive receiving surfaces to the extent a conventional wrench can no longer successfully operate the fastener. This is a particular problem where the fastener is in place and the user of the wrench is trying to loosen it.

Ring wrenches have the same number of fastener engaging surfaces as the fastener has drive receiving surfaces. With ring wrenches, because the fastener receiving aperture is closed there is no danger of the tool slipping off of the fastener and because the applied torque is distributed more evenly around the fastener, it is less likely high levels of applied torque will result in the corners of the fastener being rounded off. Unfortunately, there are many applications for which a ring wrench cannot be used. For example, where a nut is located on a pipe, it is not possible to fit a ring wrench over the pipe and so an open ended wrench has to be used.

The nut that secures a brake pipe to brake unit on an automobile is one example of a fastener that has to be worked on with an open ended wrench. Because of their position on the vehicle, these nuts are exposed to all of the adverse weather and other environmental conditions to which a vehicle is exposed. They are also relatively small in size and so in the circumferential direction of the nut, the drive receiving surfaces are relatively short. The result is that relatively high levels of torque are needed to release them. Often when such levels of torque are applied, the wrench head portion slips off rounding off the corners of the nut. This problem is often exacerbated by the location of the nut, which is typically such that only one or two pairs of drive receiving surfaces are accessible. Once the corners of those drive receiving surfaces have been wrung off, it is not usually possible to loosen the nut with a conventional open ended wrench.

SUMMARY OF THE INVENTION

The invention provides a wrench comprising a handle portion, a head portion releasably secured to the handle portion and a release device, the head portion having an inner surface that defines a fastener receiving aperture having a plurality of fastener engaging surfaces and a side entry to said fastener receiving aperture and being movable relative to the handle portion between a loading position in which the side entry is open to permit an elongate member attached to a fastener to be moved into said fastener receiving aperture to permit said fastener engaging surfaces to be moved into engagement with the fastener by relative movement of the head portion and fastener in a lengthways direction of the elongate member and an operating position in which said side entry is closed and the head portion is operable to close said fastener engaging surfaces around the fastener received in said fastener receiving aperture in response to a torque applied in a predetermined direction using said handle portion, and said release device bring arranged to at least assist in releasing the head portion from the handle portion to permit the head portion to be separated from the handle portion.

The invention includes a wrench comprising:

a handle;

a socket head having an inner surface that defines a fastener receiving aperture having a plurality of fastener engaging surfaces and a side entry to said fastener receiving aperture through which an elongate member attached to a fastener can be inserted into said fastener receiving aperture to permit said fastener engaging surfaces to be moved into engagement with the fastener by relative movement in a lengthways direction of the elongate member, said socket head being pivotably connected to said handle so as to be pivotable to positions in which it extends transversely to said handle to permit access to said side entry and a position generally in line with said handle in which entry to said side entry is blocked and being operable to close said fastener engaging surfaces around a fastener received in said fastener receiving aperture in response to a torque applied in a predetermined direction using said handle; and a force applying device arranged to apply a force to the socket head to release the socket head from said pivotable connection to allow the socket head to be separated from the handle.

The invention also includes a method of operating a wrench for applying a torque to a fastener attached to an elongate member, the method comprising:

causing relative movement of a head portion of a wrench and the elongate member such that the elongate member passes through a side entry to a fastener receiving aperture defined by the head portion and is received in the fastener receiving aperture;

causing relative movement of the head portion and elongate member in a lengthways direction of the elongate member to bring the fastener into the fastener receiving aperture;

releasably connecting a handle portion of the wrench to the head portion; and applying a torque to said handle portion in a predetermined direction to close the fastener receiving aperture around the fastener so as to engage the fastener and apply a torque thereto.

The invention also includes a wrench comprising a handle portion and a head portion, the head portion being movably connected with said handle portion so as to be movable relative to the handle portion between a storage position in which it is at least partially received within said handle portion and use positions in which it projects from the handle portion, the head portion having an inner surface that defines a fastener receiving aperture having a plurality of fastener engaging surfaces and a side entry to said fastener receiving aperture through which an elongate member attached to a fastener can be inserted into said fastener receiving aperture to permit said fastener engaging surfaces to be moved into engagement with the fastener by a movement in a lengthways direction of the elongate member and being operable to close said fastener engaging surfaces around a fastener received in said fastener receiving aperture in response to a torque applied in a predetermined direction using said handle portion.

The invention also includes a wrench comprising a handle portion and a head portion, the head portion having an outer side surface and an inner surface that defines a fastener receiving aperture that has a plurality of fastener engaging surfaces and being operable to close said fastener engaging surfaces around a fastener received in said fastener receiving aperture in response to a torque applied in a predetermined direction using said handle portion, said outer side surface having a plurality of concave portions, each of which is disposed generally opposite a said fastener engaging surface.

The invention also includes a wrench comprising a handle portion and a head portion, the head portion having an inner surface that defines a fastener receiving aperture that has a plurality of fastener engaging surfaces and being operable to close said fastener engaging surfaces around a fastener received in said fastener receiving aperture in response to a torque applied in a predetermined direction using said handle portion, at least some of said fastener engaging surfaces being provided on a portion of said head portion that comprises a series of alternately oppositely facing generally C-shaped sections arranged end to end and forming an outer end of the head portion.

The invention also includes a method of operating a wrench for applying a torque to a fastener attached to an elongate member, the method comprising:

moving a head portion of the wrench relative to a handle portion of the wrench to a position at which a side entry to a fastener receiving aperture defined by the head portion is open;

causing relative movement of the wrench and the elongate member such that the elongate member passes through the side entry and into the fastener receiving aperture, causing relative movement of the wrench and elongate member in a lengthways direction of the elongate member to bring the fastener into the fastener receiving aperture; and applying a torque to said handle portion in a predetermined direction to close the fastener receiving aperture around the fastener so as to engage the fastener and apply a torque thereto.

BRIEF DESCRIPTION OF THE DRAWINGS

In order that the invention may be well understood, an embodiment thereof, which is given by way of example only, will now be described with reference to the drawings in which:

FIG. 4 is a view corresponding to FIG. 3 but showing the wrench in an open condition;

FIG. 5 is a perspective view showing the wrench in an open condition prior to engaging a nut on a brake line; and FIG. 6 is a perspective view showing the wrench in position on the nut on the brake line.

DETAILED DESCRIPTION OF THE ILLUSTRATED EMBODIMENT

Figure 1:
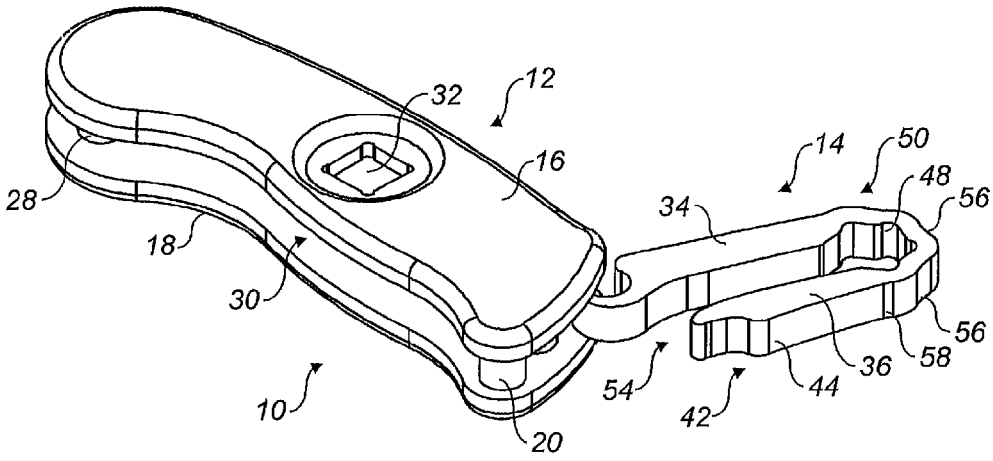
FIG. 1 is a perspective view showing a wrench.

Referring to FIGS. 1 to 4, a wrench 10 comprises a handle portion 12 and a removable head portion 14. The handle portion 12 comprises a pair of elongate plate members 16, 18. The plate members 16, 18 are secured to one another by rivets 20-28 that are arranged to maintain the plate members in parallel spaced apart relation such that there is a gap 30 defined between them. The plate members 16, 18 have a peripheral contour shaped to make the handle portion 12 easy to grip in the hand. Optionally, at least one of the plate members 16, 18 is provided with a polygonal aperture 32 shaped and sized to engage a standard size fastener head. The plate members 16, 18 may be provided with respective different sized apertures 32 or only one of the plate members may be provided with an aperture 32. However, having the same size and shape of aperture in each plate member simplifies production.

Figure 2:
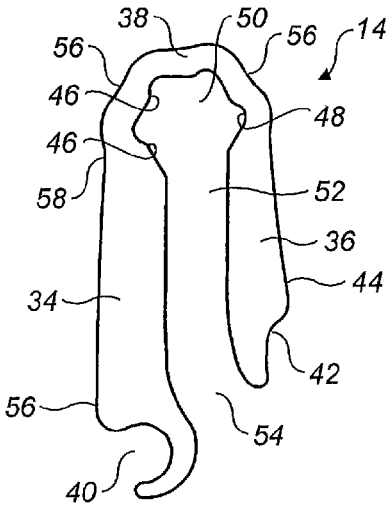
FIG. 2 shows the head portion of the wrench of FIG. 1.

The head portion 14 is a generally U-shaped member comprising elongate leg portions 34, 36 interconnected at one end by an arcuate portion 38. The leg portion 34 is longer than the leg portion 36 and has a semi-circular recess 40 provided at its free end. The leg portion 36 has a notch 42 provided in the outer side 44 of its free end. As best seen in FIGS. 2 and 4, the inner side of the arcuate portion 38 defines five fastener engaging surfaces 46. Adjacent ones of the fastener engaging surfaces 46 are interconnected by concave surface portions 48 such that they define a generally polygonal fastener receiving aperture 50 with the concave surface portions forming the corners of the aperture. The aperture 50 is shaped and sized to correspond to the fasteners the wrench is designed to be used on. The leg portions 34, 36 are spaced apart to define an elongate passage 52 that has an outer end 54 at the free ends of the leg portions and extends from the outer end to the aperture 50.

Figure 3:
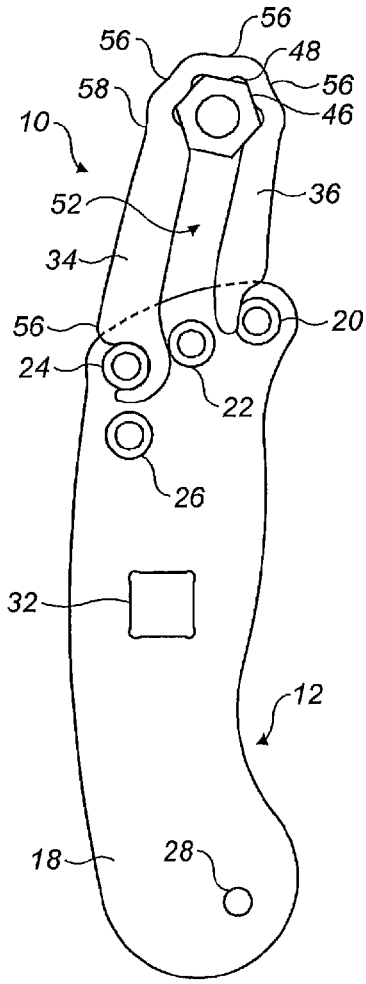
FIG. 3 shows the wrench engaging a nut and with a plate of the handle portion removed to show the layout of the interior of the handle.

The fastener engaging surfaces 46 are flat surfaces angled so as to be able to engage respective drive receiving flat surfaces of the size and shape of fastener the head portion 14 is intended to operate. As best seen in FIG. 3, the fastener engaging surfaces 46 and concave surface portions 48 are arranged such that the fastener engaging surfaces engage the leading ends of the respective fastener flats in the torque applying direction of the wrench (i.e. the anticlockwise direction as viewed in FIG. 3) and the concave surface portions are located over the trailing end portion of the fastener flats at which the application of torque is not required.

The outer side surface of the arcuate portion 38 has a number of concave portions 56 that are disposed generally opposite a respective fastener engaging surface 46. Specifically, there are concave portions 56 disposed generally opposite the three fastener engaging surfaces 46 at the end of the head portion 14. There are also concavities 58 in the outside surface of each of the leg portions 34, 36 behind (i.e. generally opposite) the fastener engaging surfaces 46 immediately adjacent the passage 52. The effect of the convex fastener engaging surfaces 46, concave surface portions 48, concave portions 56 and concavities 58 is to divide the part of the head portion 14 that defines the fastener receiving apertures 50 into a series of alternating oppositely facing generally C-shaped portions that provide a corrugated effect. It has been found that the structure resulting from this configuration provides flexibility in the fastener receiving aperture shape that can provide adjustability for adjusting to grip misshapen and damaged fasteners coupled with sufficient strength to operate tight fasteners. The concave surface portions 48 define the corners of the polygonal fastener receiving aperture 50 and act in the manner of a curved spring hinge. It will be appreciated that the curvature of the concave surface portions 48 allows the hinge-like action and avoids the problem of stress concentration that would arise if sharp corners were used.

The rivets 20, 22, 24, 26 are positioned and shaped such that they also serve as posts that in use of the wrench 10 are engaged by the head portion 14. As shown in FIGS. 3 and 4, the semi-circular recess 40 of the leg portion 34 engages the rivet 24, which serves as a mount on which the head portion 14 can pivot between the open and closed positions shown. When the handle portion 12 is pivoted anticlockwise from the position shown in FIG. 4 to close the wrench (the position shown in FIG. 3), the notch 42 in the end of the leg portion 36 engages the rivet 20. As will be described in more detail below, continued anticlockwise rotation of the handle portion 12 drives the rivet 20 into the notch 42 such that a bending moment is applied to the leg portion 36 to cause the fastener engaging surfaces 46 to close around a fastener received in the fastener receiving aperture 50.

The rivet 22 is positioned between the rivets 20, 24 such that it provides an abutment that limits movement of the free end of the leg portion 36 towards the leg portion 34. This prevents excessive deformation of the head portion 14. In some orientations of the head portion 14, the rivet 22 also assists in keeping the recess 40 engaged with the rivet 24.

As can be seen in FIG. 4, if the head portion 14 is pivoted far enough in the anticlockwise direction, the outer side surface 56 of the leg portion 34 engages the rivet 26 close to semi-circular recess 40. If rotation of the head portion 14 is continued, the side surface 56 presses against the rivet 26, causing the head portion to pivot about the rivet 26 and forcing the semi-circular recess 40 to disengage from the rivet 24. This makes it easy to disengage and remove the head portion 14 from the handle portion 12.

Use of the wrench 10 to release a nut 70 securing a brake pipe 72 to a brake unit 74 will now be described with particular reference to FIGS. 3 to 6. In order to bring the fastener engaging surfaces 46 into engagement with the drive receiving surfaces 76 of the nut 70, the head portion 14 of the wrench 10 is first moved to an open position such as those shown in FIGS. 4 and 5. To put it in an open position, the head portion 14 is pivoted about the rivet 24 until the outer end 54 of the passage 52 is fully exposed. While it may not always be necessary to go so far, fitting the wrench 10 onto the nut 70 is most easily achieved if the head portion 14 is positioned such that its lengthways direction is disposed at approximately 90° or more to the lengthways direction of the handle portion 12. With the outer end 54 of the passage 52 fully exposed, the head portion 14 is moved transversely to the brake pipe 72 such that the pipe passes through the passage towards the fastener receiving aperture 50. Once the brake pipe 72 is received in the fastener receiving aperture 50, the wrench is moved in a direction along the pipe that brings the head portion 14 onto the nut 70 with the fastener engaging surfaces 46 engaging the drive receiving surfaces 76 of the nut.

Once the nut 70 is engaged in the fastener receiving aperture 48, the handle portion 12 is rotated towards the head portion 14 (in the anticlockwise direction as viewed in FIGS. 4 and 5) to close the wrench 10 and bring the rivet 20 into engagement with the notch 42. Where convenient, this closing process may take place before the wrench is moved along the pipe 72 to engage the nut 70. Continued rotation of the handle portion 12 in the anticlockwise direction presses the rivet 20 against the notch 42 to apply a moment to the free end of the leg portion 36 that pushes that end towards the leg portion 34 and in the process narrows the passage 52. This movement of the leg portion 36 causes the arcuate portion 38 to flex and stretch around the nut 70 until the fastener engaging surfaces 46 firmly grip the nut. Once the nut 70 is firmly gripped, continued anticlockwise rotation of the handle portion 12 causes a torque to be applied to the nut 70, which is turned anticlockwise and so released from the brake unit 74.

It will be understood that the process of using the wrench 10 to release a nut 70 securing a brake pipe as previously described could be modified by fitting the head portion 14 to the nut without the handle portion 12 and then connecting the handle portion to the head portion. This may be convenient when the wrench is used in confined spaces.

It will be appreciated that the gripping force applied by the fastener engaging surfaces 46 will increase as the torque applied to the handle portion 12 increases and so in cases in which high levels of torque are needed to move a tight fastener, the gripping force will be increased and the wrench should not slip on the fastener.

It will be appreciated that the concave outer side surface portions 56 of the head portion 14 improve the flexibility of the head portion making it better able to adjust its shape in response to the applied torque for gripping a fastener, even in cases in which due to damage to the fastener, the fastener's drive receiving surfaces are rounded off and undersize such as to be quite different to the design size.

It will be appreciated that as viewed in FIGS. 3 to 6, in order to tighten the nut 70, the same process would be followed, but with the wrench 10 flipped over to allow operation in the clockwise direction.

It will be appreciated that by making the head portion 14 releasable from the handle portion 12, it is possible to have just one handle portion for a range of sizes of head portion. The differences in the head portions may be the size and/or shape of the fastener receiving aperture and/or the length or angularity of the head portion. It will be appreciated that there is economic efficiency in having one handle portion that can accommodate multiple interchangeable head portions.

It will be understood that in embodiments having a releasable, detachable, head portion, it will often be desirable to make the releasable connection between the head portion and handle portion sufficiently secure to prevent the head portion from being accidentally disconnected when in use. For example, the head portion may be configured to take advantage of the resilience of the material from which it is made such that the recess 40 receives the rivet 24 by snap-fitting. Alternatively, or additionally, the head portion may be fitted to the handle portion via a circuitous path that makes it difficult for the head portion to be disengaged from the handle portion by accident regardless of the strength of the actual connection between the head portion and handle portion. For example and referring to FIG. 3, the end region of the leg portion 34 that connects with the handle portion and the rivets 22, 24 could be configured such that the leg portion needs to be threaded into the connected position shown and will not readily be released. It will be understood that in general it will often be desirable for a detachable head portion to be quick-fit releasable by, for example, a push-fit and/or snap-fit connection.

It will be understood that where a releasably securable head portion is provided, it may be desirable to provide a release device to at least assist in releasing the head portion from the handle portion. The release device may take the form of an abutment surface positioned to apply a force that helps to break the connection between the head portion and handle portion in similar fashion to the rivet 26 shown in FIG. 3. It will of course be understood that many other release devices, which may comprise more complex mechanisms, could be used.

It will be appreciated that the head portion 14 could be secured to the handle portion 12 such that it can be permanently connected and for practical purposes not releasable.

For a permanent connection, the rivet 26 is not needed and can be removed, if desired, to allow the head portion to be rotated anticlockwise (as viewed in FIGS. 3 to 6) such that it can be stored in the gap 30 between the plate members 16, 18 of the handle portion. In that case, the rivet 28 could be positioned to act as a detent that would hold the head portion 14 within the gap 30. Alternatively, a separate detent or other form of retention device could be used.

It will be appreciated that it is convenient to give the rivets that hold the halves of the handle portion together a dual function. However, it is to be understood that the pivot mounting for the head portion and abutment surfaces may be provided by means other than the rivets. It will also be appreciated that other forms of fastener could be substituted for the rivets and still have a dual function as described.

The wrench is described in use operating a nut 70 on a brake pipe 72. It will be appreciated that this is not to be taken as limiting and that the wrench can be used to operate fasteners generally. In particular, while the wrench is particularly suited to use on fasteners incorporated in elongate structures, such as pipes, that would not be accessible to a conventional ring wrench, it will be appreciated that the wrench can be used on fasteners that could, for example, be accessed by a conventional open ended and/or ring wrench.

While certain embodiments of the present invention have been shown and described, it will be obvious to those skilled in the art that changes and modifications may be made without departing from the spirit and scope of the invention. The matter set forth in the foregoing description and accompanying drawings is offered by way of illustration only and not as a limitation. The actual scope of the invention is intended to be defined in the following claims.

What is claimed is:

1. A wrench comprising:

a handle portion;

a head portion releasably secured to said handle portion;

a release device;

said head portion having an inner surface that defines a fastener receiving aperture having a plurality of fastener engaging surfaces and a side entry to said fastener receiving aperture and being movable relative to said handle portion between a loading position in which the side entry is open to permit an elongate member attached to a fastener to be moved into said fastener receiving aperture to permit said fastener engaging surfaces to be moved into engagement with the fastener by relative movement of said head portion and fastener in a lengthways direction of the elongate member and an operating position in which said side entry is closed and said head portion is operable to close said fastener engaging surfaces around the fastener received in said fastener receiving aperture in response to a torque applied in a predetermined direction using said handle portion; and said release device being arranged to apply a release force to said head portion to at least assist in releasing said head portion from said handle portion to permit said head portion to be separated from said handle portion.

2. A wrench as claimed in claim 1, wherein said release device comprises an abutment surface provided on said handle portion and arranged to be engageable by said head portion in response to relative rotation of said head portion and said handle portion for releasing said head portion from said handle portion.

3. A wrench as claimed in claim 1, comprising a plurality of head portions, each said head portion being releasably securable to said handle portion.

4. A wrench as claimed in claim 1, wherein said head portion is releasably securable to said handle portion by a snap-fit connection.

5. A wrench as claimed in claim 1, wherein said head portion comprises an outer side surface having a plurality of concave portions that are each disposed generally opposite a respective fastener engaging surface.

6. A wrench as claimed claim 1, wherein adjacent ones of said fastener engaging surfaces are connected by respective concave surface portions of said inner surface.

7. A wrench as claimed in claim 6, wherein, in a torque applying direction of the wrench, said fastener engaging surfaces are arranged for engaging a leading end portion of respective drive receiving surfaces of a fastener and said head portion is configured to be used on with the concave surface portions disposed adjacent respective trailing end portions of said drive receiving surfaces.

8. A wrench as claimed in claim 1, wherein, when secured to said handle portion, said head portion is pivotable between said loading and operating positions, and wherein, when in said loading position, said head portion extends transversely to said handle portion and when in said operating position, said head portion extends generally in line with said handle portion.

9. A wrench as claimed in claim 1, wherein said head portion comprises a first elongate portion, a second elongate portion and an arcuate portion connecting said first and second elongate portions, said side entry being defined between said first and second elongate portions.

10. A wrench as claimed in claim 9, wherein said head portion is releasably securable to said handle portion by a connection between said handle portion and said first elongate portion and said handle portion is arranged to apply said torque in a predetermined direction to a free end region of said second elongate portion.

11. A wrench as claimed in claim 1, wherein said handle portion comprises two generally opposed elongate members disposed in spaced apart relation, a first pin member extending between said elongate members and a second pin member extending between said elongate members, said first and second pin members being disposed at a first end region of said handle portion, said first pin member providing a pivot mount to which said head portion is releasably pivotally securable and said second pin member providing an abutment surface by which said torque applied in a predetermined direction is applied to said head portion.

12. A wrench comprising:

a handle portion;

a head portion releasably secured to said handle portion;

a release device;

said head portion having an inner surface that defines a fastener receiving aperture having a plurality of fastener engaging surfaces and a side entry to said fastener receiving aperture and being movable relative to said handle portion between a loading position in which the side entry is open to permit an elongate member attached to a fastener to be moved into said fastener receiving aperture to permit said fastener engaging surfaces to be moved into engagement with the fastener by relative movement of said head portion and fastener in a lengthways direction of the elongate member and an operating position in which said side entry is closed and said head portion is operable to close said fastener engaging surfaces around the fastener received in said fastener receiving aperture in response to a torque applied in a predetermined direction using said handle portion;

said release device being arranged to at least assist in releasing said head portion from said handle portion to permit said head portion to be separated from said handle portion;

wherein said handle portion comprises two generally opposed elongate members disposed in spaced apart relation, a first pin member extending between said elongate members and a second pin member extending between said elongate members, said first and second pin members being disposed at a first end region of said handle portion, said first pin member providing a pivot mount to which said head portion is releasably pivotally securable and said second pin member providing an abutment surface by which said torque applied in a predetermined direction is applied to said head portion; and a third pin member disposed generally intermediate said first and second pin members for limiting deformation of said head portion by said torque applied in a predetermined direction.

13. A wrench comprising:

a handle portion;

a head portion releasably secured to said handle portion;

a release device;

said head portion having an inner surface that defines a fastener receiving aperture having a plurality of fastener engaging surfaces and a side entry to said fastener receiving aperture and being movable relative to said handle portion between a loading position in which the side entry is open to permit an elongate member attached to a fastener to be moved into said fastener receiving aperture to ermit said fastener engaging surfaces to be moved into engagement with the fastener by relative movement of said head portion and fastener in a lengthways direction of the elongate member and an operating position in which said side entry is closed and said head portion is operable to close said fastener engaging surfaces around the fastener received in said fastener receiving aperture in response to a torque applied in a predetermined direction using said handle portion;

said release device being arranged to at least assist in releasing said head portion from said handle portion to permit said head portion to be separated from said handle portion wherein said handle portion comprises two generally opposed elongate members disposed in spaced apart relation, a first pin member extending between said elongate members and a second pin member extending between said elongate members, said first and second pin members being disposed at a first end region of said handle portion, said first pin member providing a pivot mount to which said head portion is releasably pivotally securable and said second pin member providing an abutment surface by which said torque applied in a predetermined direction is applied to said head portion; and wherein said first end region includes a first end of said handle portion and the release device comprises a further pin member that is disposed further from said first end of said handle portion than said first pin member and is arranged to be engageable by said head portion by relative rotation of said head portion and said handle portion for disconnecting said head portion from said first pin member.

14. A wrench as claimed in claim 1, wherein said fastener receiving aperture has a plurality of corners and said head portion is configured such that a spring hinge portion is defined by at least one of said corners.

15. A wrench as claimed in claim 1, wherein said head portion is push-fit releasably securable to said handle portion.

16. A wrench as claimed in claim 1, wherein said head portion is quick-fit releasably securable to said handle portion.

17. A wrench as claimed in claim 1, wherein said head portion is releasably securable to said handle portion by a pivot connection.

18. A wrench comprising:

a handle;

a socket head having an inner surface that defines a fastener receiving aperture having a plurality of fastener engaging surfaces and a side entry to said fastener receiving aperture through which an elongate member attached to a fastener can be inserted into said fastener receiving aperture to permit said fastener engaging surfaces to be moved into engagement with the fastener by relative movement in a lengthways direction of the elongate member, said socket head being pivotably connected to said handle so as to be pivotable to positions in which it extends transversely to said handle to permit access to said side entry and a position generally in line with said handle in which entry to said side entry is blocked and being operable to press said fastener engaging surfaces against a fastener received in said fastener receiving aperture in response to a torque applied in a predetermined direction using said handle; and a force applying device arranged to apply a force to the socket head to release the socket head from said pivotable connection to allow the socket head to be separated from said handle.

19. A method of operating a wrench for applying a torque to a fastener attached to an elongate member, the method comprising:

causing relative movement of a head portion of a wrench and the elongate member such that the elongate member passes through a side entry to a fastener receiving aperture defined by said head portion and is received in the fastener receiving aperture;

causing relative movement of said head portion and elongate member in a lengthways direction of the elongate member to bring the fastener into the fastener receiving aperture;

releasably connecting a handle portion of the wrench to said head portion;

applying a torque to said handle portion in a predetermined direction to close the fastener receiving aperture around the fastener so as to engage the fastener and apply a torque thereto; and disconnecting said head portion from said handle portion, wherein said disconnecting comprises operating a force applying device to apply a force to said head portion to disconnect said head portion from said handle portion.

20. A method of operating a wrench as claimed in claim 19, comprising releasably pivotally connecting said head portion to said handle portion when the fastener is received in the fastener receiving aperture.

21. A method of operating a wrench as claimed in claim 19, wherein the elongate member is a pipe and the fastener is a nut that is rotatable relative to the pipe for securing the pipe of a threaded member.

22. A method of operating a wrench as claimed in claim 21, wherein the pipe is a brake pipe on an automobile.

23. A wrench comprising:

a handle portion; and a head portion, wherein the head portion is movably connected with said handle portion so as to be movable relative to the handle portion between a storage position in which it is at least partially received within said handle portion and use positions in which it projects from the handle portion, wherein the head portion has an inner surface that defines a fastener receiving aperture having a plurality of fastener engaging surfaces and a side entry to said fastener engaging aperture through which an elongate member attached to a fastener can be inserted into said fastener receiving aperture to permit said fastener engaging surfaces to be moved into engagement with the fastener by a movement in a lengthways direction of the elongate member and being operable to close said fastener engaging surfaces around a fastener received in said fastener receiving aperture in response to a torque applied in a predetermined direction using said handle portion, wherein said movable connection is a pivot connection and said handle portion comprises two generally opposed elongate members disposed in spaced apart relation, a first pin member extending between said elongate members and a second pin member extending between said elongate members, said pin members being disposed at a first end region of the handle portion, said first pin member providing a pivot mount to which the head portion is pivotally connected and the second pin member providing an abutment surface by which said torque applied in a predetermined direction is applied to the head portion, and wherein said handle portion is provided with third pin member disposed generally intermediate said first and second pin members for limiting deformation of said head portion by said torque applied in a predetermined direction.

24. A wrench as claimed in claim 23, wherein said head portion comprises an outer side surface having a plurality of concave portions that are each disposed generally opposite a respective fastener engaging surface.

25. A wrench as claimed in claim 24, wherein adjacent ones of said fastener engaging surfaces are connected by respective concave surface portions of said inner surface.

26. A wrench as claimed in claim 25, wherein in a torque applying direction of the wrench, said fastener engaging surfaces are arranged for engaging a leading end portion of respective drive receiving surfaces of a fastener and said head portion is configured to be used on with the concave surface portions disposed adjacent respective trailing end portions of said drive receiving surfaces.

27. A wrench as claimed in claim 23, wherein said head portion is pivotally connected to said handle portion so as to be pivotable to positions in which it extends transversely to said handle portion to permit entry to said side entry and a position generally in line with said handle line with said handle portion in which entry to said side entry is blocked.

28. A wrench as claimed in claim 23, wherein said head portion comprises a first elongate portion, a second elongate portion and an arcuate portion connecting said first and second elongate portions, said side entry being defined between said first and second elongate portions.

29. A wrench as claimed in claim 28, wherein the connection between said head portion and handle portion is with said first elongate portion and said handle portion is arranged to apply said torque in a predetermined direction to a free end region of said second elongate portion.

30. A wrench as claimed in claim 23, wherein said first end region includes a first end of said handle portion and the wrench further comprises a pin member disposed further from said first end of said handle portion than said first pin member and arranged to be engageable by said head portion by relative rotation of said head portion and said handle portion for disconnecting said head portion from said first pin member.

31. A wrench as claimed in claim 23, wherein at least one of said pin members comprises a fastener securing said elongate members together.

32. A wrench as claimed in claim 23, wherein said fastener receiving aperture has a plurality of corners and said head portion is configured such that a spring hinge portion is defined at least one of said corners.

33. A wrench comprising:

a handle portion;

a head portion releasably secured to said handle portion;

said head portion having an inner surface that defines a fastener receiving aperture that has a plurality of fastener engaging surfaces and a side entry to said fastener receiving aperture and being movable relative to said handle portion between a loading position, in which the side entry is open to permit an elongate member attached to a fastener to be moved into said fastener receiving aperture to permit said fastener engaging surfaces to be moved into engagement with the fastener by relative movement of said head portion and fastener in a lengthways direction of the elongate member, and an operating position in which said side entry is closed and said head portion is operable to close said fastener engaging surfaces around the fastener received in said fastener receiving aperture in response to a torque applied in a predetermined direction using said handle portion;

said head portion having an outer side surface having a plurality of concave portions, each of which is disposed generally opposite a respective fastener engaging surface to provide reduced thickness regions that reduce rigidity of said head portion at said concave portions; and the release device being arranged to apply a release force to said head portion to at least assist in releasing the head portion from the handle portion to permit the head portion to be separated from the handle portion.

34. A wrench as claimed in claim 33, wherein adjacent said fastener engaging surfaces are connected by respective concave surface portions of said inner surface.

35. A wrench as claimed in claim 34, wherein, in a torque applying direction of the wrench, said fastener engaging surfaces are arranged for engaging a leading end portion of respective drive receiving surfaces of a fastener and said head portion is configured to be used on with the concave surface portions disposed adjacent respective trailing end portions of said drive receiving surfaces.

36. A wrench as claimed in claim 35, wherein said head portion is pivotable on said handle between a storage position in which said head portion is received in said handle portion and use positions external to said handle portion.

37. A wrench as claimed in claim 33, wherein said head portion is releasably secured to a mount on said handle portion about which mount said head portion is pivotable.

38. A wrench as claimed in claim 36, wherein said head portion defines a side opening to said fastener receiving aperture through which an elongate part connected to a fastener to be engaged can be entered into said fastener receiving aperture and is pivotable between positions in which entry to said opening is permitted and a position in which entry to said opening is blocked.

39. A wrench as claimed in claim 38, wherein said head portion comprises a first elongate portion, a second elongate portion disposed generally opposite said first elongate portion and an arcuate portion connecting said elongate portions, said side opening being defined between said elongate portions and said first elongate portion being configured for pivotal connection with said handle portion.

40. A wrench as claimed in claim 39, wherein said second elongate portion has a free end that is detached from said handle portion when said handle portion is in positions in which entry to said opening is permitted and engages an abutment surface on said handle portion when said handle portion is in said position in which entry to said opening is blocked, said abutment surface being arranged to apply said torque applied in said predetermined direction using said handle portion to said free end of the second elongate portion to close said fastener engaging surfaces around a fastener received in said fastener receiving aperture.

41. A wrench as claimed in claim 38, wherein said second elongate portion defines a formation for engaging said abutment surface.

42. A wrench as claimed in claim 33, wherein said handle portion is provided with an abutment surface for limiting closure of said fastener engaging surfaces around a fastener received in said fastener receiving aperture.

43. A wrench as claimed in claim 38, wherein said head portion is releasably secured to a mount on said handle portion about which mount said head portion is pivotable and said handle portion comprises an abutment surface arranged to be engageable by said head portion when rotated relative to said handle portion in a direction opposite said predetermined direction for driving said head portion off of said mount.

44. A wrench comprising:

a handle portion;

a head portion releasably secured to said handle portion; and a release device;

said head portion having an inner surface that defines a fastener receiving aperture that has a plurality of fastener engaging surfaces and a side entry to said fastener receiving aperture and being movable relative to said handle portion between a loading position, in which the side entry is open to permit an elongate member attached to a fastener to be moved into said fastener receiving aperture to permit said fastener engaging surfaces to be moved into engagement with the fastener by relative movement of said head portion and fastener in a lengthways direction of the elongate member, and an operating position, in which said side entry is closed and said head portion is operable to close said fastener engaging surfaces around the fastener received in said fastener receiving aperture in response to a torque applied in a predetermined direction using said handle portion, at least some of said fastener engaging surfaces being provided on a portion of said head portion that comprises a series of alternately oppositely facing generally C-shaped sections arranged end to end and forming an outer end of said head portion; and said release device being arranged to apply a release force to said head portion to at least assist in releasing said head portion from said handle portion to permit said head portion to be separated from said handle portion.

* * * * *

UNITED STATES PATENT AND TRADEMARK OFFICE

CERTIFICATE OF CORRECTION

PATENT NO. : 8,117,948 B2
APPLICATION NO. : 12/259591
DATED : February 21, 2012
INVENTOR(S) : Nigel A. Buchanan It is certified that error appears in the above-identified patent and that said Letters Patent is hereby corrected as shown below:

Column 8
Line 22, Claim 8, Insert --,-- after "and"

Column 9
Line 31, Claim 13, "ermit" should be --permit--
Line 43, Claim 13, Insert --;-- after "portion"

Column 11
Line 42, Claim 26, Insert --,-- after "wherein"
Line 53, Claim 27, Delete "handle line with said" after "in line with said"

Column 12
Line 27, Claim 33, Insert --,-- after "position"

Signed and Sealed this
Fourteenth Day of August, 2012

David J. Kappos

David J. Kappos
*Director of the United States Patent and Trademark Office*